US007480964B2

(12) United States Patent
Vidal

(10) Patent No.: US 7,480,964 B2
(45) Date of Patent: Jan. 27, 2009

(54) HAND TOOL HANDLE MODIFICATION SYSTEM

(76) Inventor: Michael A. Vidal, 1831 N. Pass Ave., Burbank, CA (US) 91505

( * ) Notice: Subject to any disclaimer, the term of this patent is extended or adjusted under 35 U.S.C. 154(b) by 0 days.

(21) Appl. No.: 11/345,182

(22) Filed: Jan. 31, 2006

(65) Prior Publication Data

US 2007/0056144 A1 Mar. 15, 2007

Related U.S. Application Data

(60) Division of application No. 10/773,992, filed on Feb. 6, 2004, now Pat. No. 7,017,236, which is a continuation of application No. 09/864,519, filed on May 23, 2001, now Pat. No. 6,732,411.

(51) Int. Cl.
*B25G 1/10* (2006.01)
*B25G 1/00* (2006.01)

(52) U.S. Cl. ..... 16/430; 16/442; 16/421; 16/110.1; 16/DIG. 12; 16/DIG. 41; 7/143; 81/489

(58) Field of Classification Search ..... 16/426, 16/430, 110.1, DIG. 12, DIG. 41; 42/71.01, 42/70.07; 81/20, 177.1, 489; 135/71, 72, 135/75, 76, 73; 7/143, 145
See application file for complete search history.

(56) References Cited

U.S. PATENT DOCUMENTS

| | | | | | |
|---|---|---|---|---|---|
| 522,181 | A | * | 6/1894 | Neal | 81/489 |
| 1,463,191 | A | | 7/1923 | Batten | |
| 2,244,585 | A | * | 6/1941 | Tweit | 16/426 |
| 2,839,822 | A | * | 6/1958 | Dillingham et al. | 29/245 |
| 2,951,259 | A | * | 9/1960 | Brockner | 16/431 |
| 2,991,907 | A | * | 7/1961 | Kinnison | 220/738 |
| 3,217,635 | A | | 11/1965 | Scavullo | |
| 3,773,375 | A | | 11/1973 | Nehls | |
| 3,817,521 | A | | 6/1974 | Wright | |
| 4,072,311 | A | | 2/1978 | Bertucci | |
| 4,364,585 | A | | 12/1982 | Shields | |
| 4,369,546 | A | | 1/1983 | Zientara | |
| 4,644,740 | A | | 2/1987 | Lee | |
| 5,018,734 | A | | 5/1991 | Allsop | |
| 5,315,724 | A | * | 5/1994 | Trujillo et al. | 7/145 |
| 5,326,134 | A | * | 7/1994 | Hiser | 280/822 |
| 5,529,357 | A | | 6/1996 | Hoffman | |
| 5,609,175 | A | | 3/1997 | Gerry et al. | |
| 6,082,795 | A | | 7/2000 | Fornelli | |
| 6,305,051 | B1 | | 10/2001 | Cho | |

(Continued)

*Primary Examiner*—Robert J Sandy
(74) *Attorney, Agent, or Firm*—Denton L. Anderson; Sheldon Mak Rose & Anderson PC

(57) ABSTRACT

A hand-held instrument has a business end and a handle attached to the business end. The handle has a gripping portion and a longitudinal axis. A knob is provided on the gripping portion of the handle to facilitate the wielding of the hand-held instrument. The knob is disposed such that it projects away from the handle in a direction transverse to the longitudinal axis of the handle. In a preferred, but not required embodiment, the knob is removably attached to the handle by a quick release attachment device. In a typical, but not required, such embodiment, the quick release attachment device includes a male connection pin disposed within the knob and a female receptor disposed within the hand tool.

5 Claims, 10 Drawing Sheets

U.S. PATENT DOCUMENTS 6,732,411 B2 5/2004 Vidal
RE38,573 E * 8/2004 Wells ..... 280/822
7,017,236 B2 3/2006 Vidal

* cited by examiner

HAND TOOL HANDLE MODIFICATION SYSTEM

RELATED APPLICATIONS

This application is a divisional application of U.S. patent application Ser. No. 10/773,992 filed Feb. 6, 2004, now U.S. Pat. No. 7,017,236, which was a continuation of U.S. patent application Ser. No. 09/864,519 filed May 23, 2001, now U.S. Pat. No. 6,732,411.

BACKGROUND OF THE INVENTION

This invention is directed to hand tools for pounding, chopping or swinging, such as hammers and hatchets. The invention addresses the problem of how to maximize control of the tool and minimize fatigue to the user of the tool.

DESCRIPTION OF THE DRAWINGS

These features, aspects and advantages of the present invention will become better understood with regard to the following description, appended claims and accompanying figures where:

DESCRIPTION OF THE INVENTION

Figures 1, 2, 3, 4:
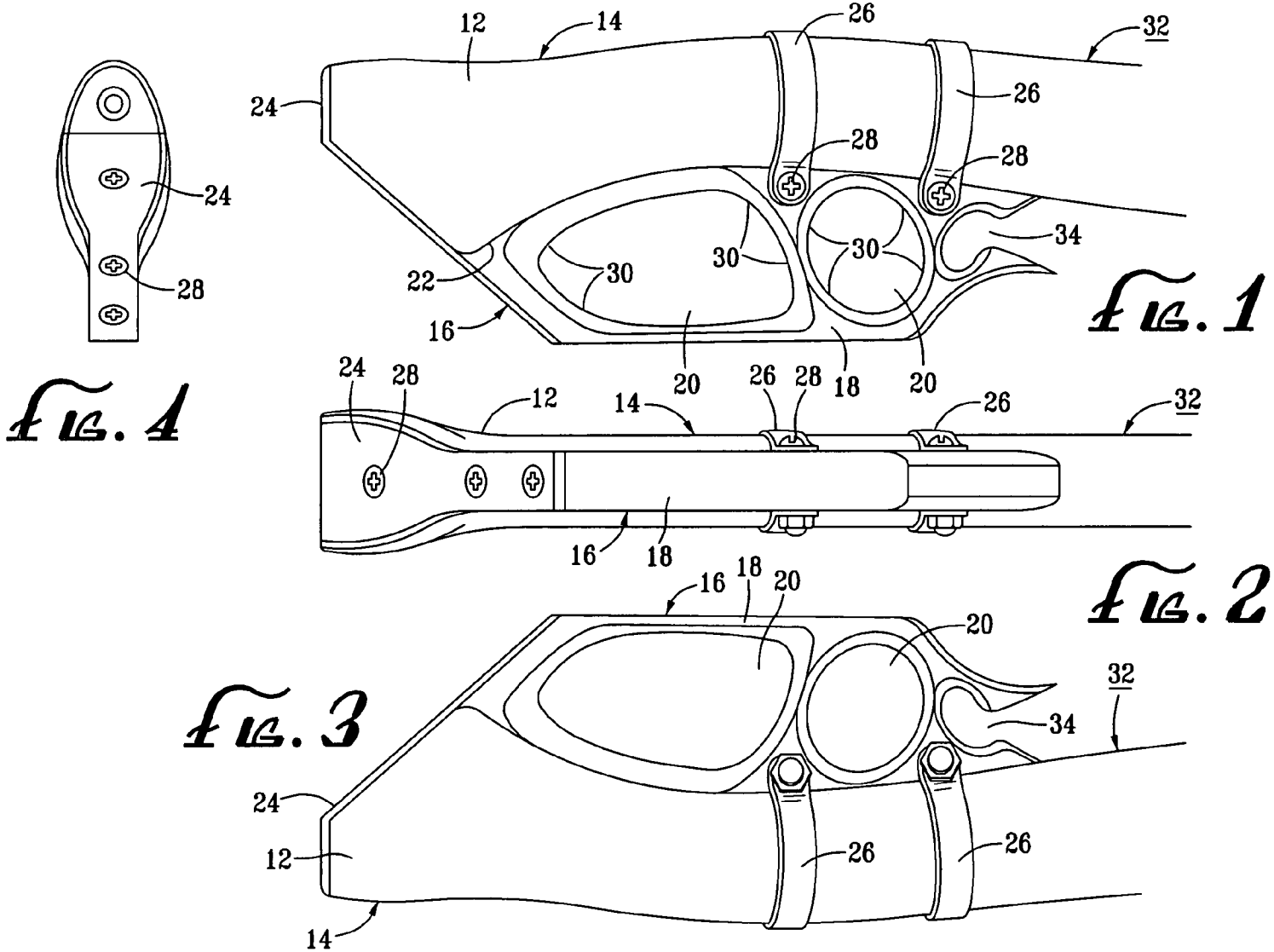
FIG. 1 is a side view of a basket having features of the invention.
FIG. 2 is a bottom side view of the basket illustrated in FIG. 1.
FIG. 3 is a reverse side view of the basket illustrated in FIG. 1.
FIG. 4 is a butt end view of the basket illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

In yet another embedment of the invention, one or more of the worker's hand tools 12 are readily attachable and deattachable by a lanyard 14 which prevents the hand tool 12 from falling away from the worker.

The lanyard 14 comprises a short length of flexible cable 16 retained on a cable retainer spool 14. At the free end 20 of the cable 16 is a tool attachment connector 22 which allows the lanyard 14 to be readily attached to and deattached from a hand tool 12. The cable 16 is typically made from a thin metallic material. Other materials, such as nylon cord, chain, braided cable, woven elastic cord ("bungee cord"), plastic mono-filament line ("fishing line"), and even string can also be used. Typically, the cable 12 has a length of between about 2 feet and about 4 feet.

The cable 16 should be sufficiently strong so as to not break when a hand tool 12 used with the lanyard 14 is inadvertently dropped by the user. The cable 16 also should be sufficiently flexible to allow full use of the hand tool 12 when the hand tool 12 is attached to the lanyard 14.

The cable retainer spool 18 typically comprises a rotatable spool 24 disposed within a spool housing 26. Preferably, the rotatable spool 24 is spring mounted within the spool housing 26 so as to make the cable 16 retractable. Preferably, the spring mounted rotatable spool 24 only exerts sufficient force to draw the cable 16 back into the cable housing 26 when the tool 12 to which the lanyard 14 is attached is not in use.

The spool housing 26 can be conveniently housed within a pouch 28, such as a leather pouch, as illustrated in the drawings.

Figure 6:
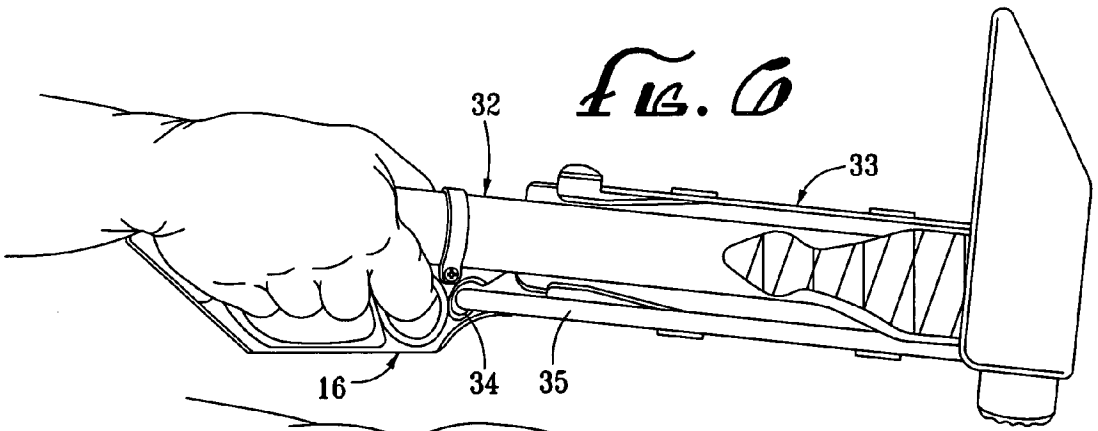
FIG. 6 is a side view of a tool carrying the basket illustrated in FIG. 1, the tool being shown engaged with a safety scabbard.
Figure 8:
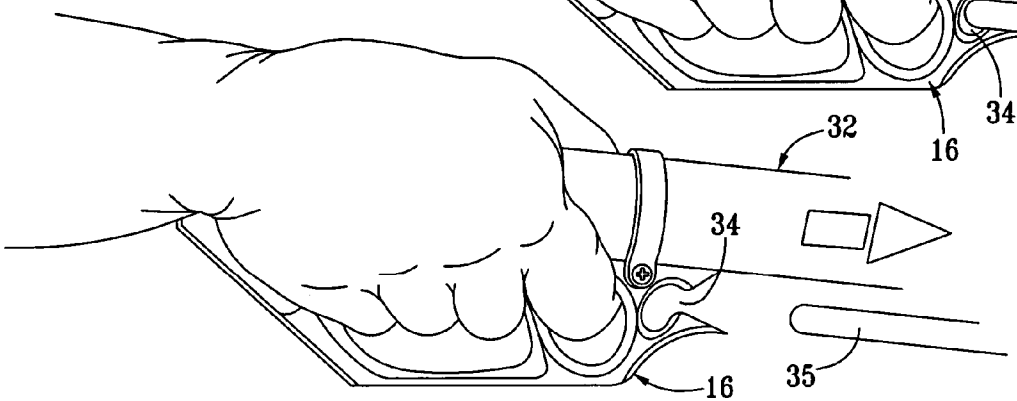
FIG. 8 is a detail view of the hand tool illustrated in FIG. 6, the tool being shown disengaged from the safety scabbard.
Figure 9:
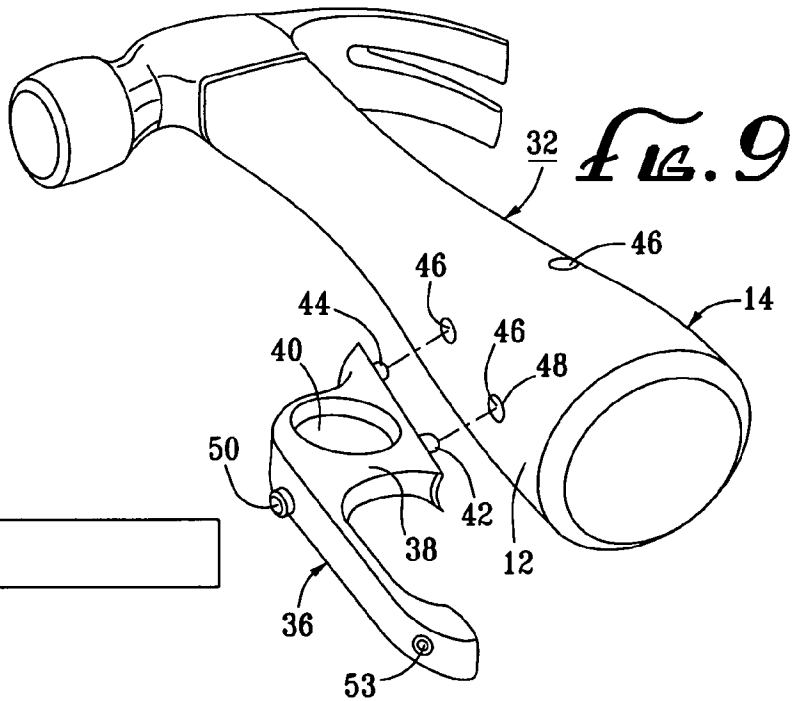
FIG. 9 is an exploded view of a grip guard having features of the invention.
Figure 11:
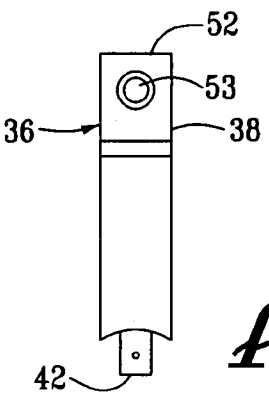
FIG. 11 is an end view of the grip guard illustrated in FIG. 9.
Figure 10:
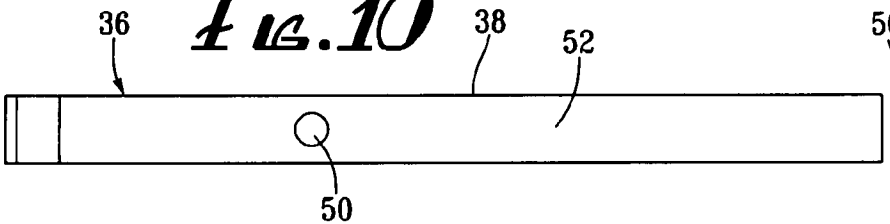
FIG. 10 is a back side view of the grip guard illustrated in FIG. 9.
Figure 12:
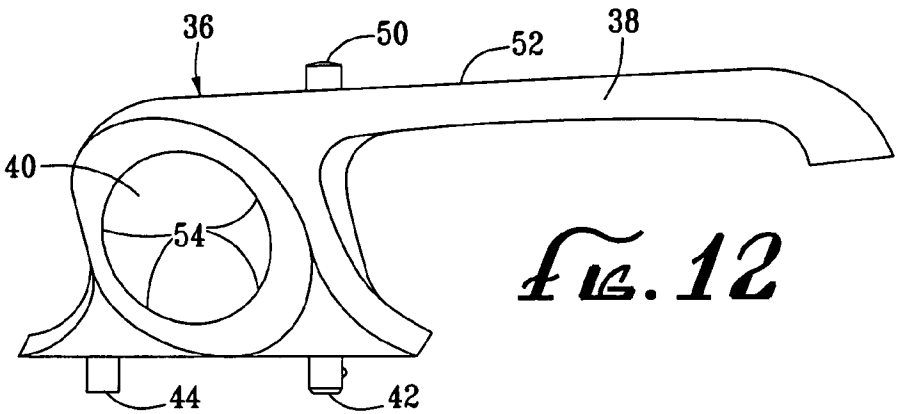
FIG. 12 is a side view of the grip guard illustrated in FIG. 9.
Figure 13:
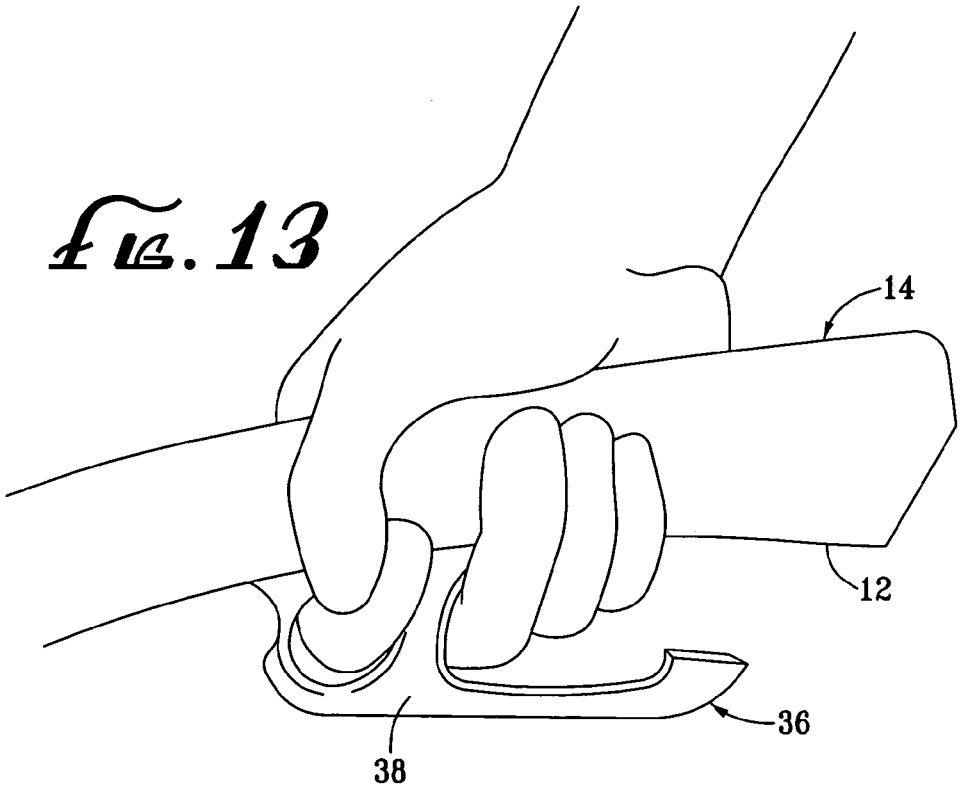
FIG. 13 is a side view of a handle carrying a grip guard having features of the invention.

The lanyard 14 further comprises a retainer spool attachment device 30, such as clips, clamps or other mechanical attachment means which facilitate the rapid attachment and deattachment of the cable retainer spool 24 to the person of the user or to a solid object proximate to where the user is working. FIGS. 11 and 12 illustrate how the cable retainer spool 24 is attached to the shoulder strap 31 of the user. FIGS. 1-3 illustrate how the cable retainer spool 24 is attached to the worker's tool belt 32. FIGS. 6, 8 and 10 illustrate the attachment of the cable retainer spool 24 to the wrist of the user using a wrist band 34. The wrist band 34 is typically made from a nylon cloth or leather construction. The wrist band 34 has the additional advantage of acting as an elastic bandage, thereby supporting the wrist and reducing fatigue in the wrist. Typically, the wrist band 34 is attachable and deattachable to the user using hook and loop fasteners or snaps.

Figure 7:
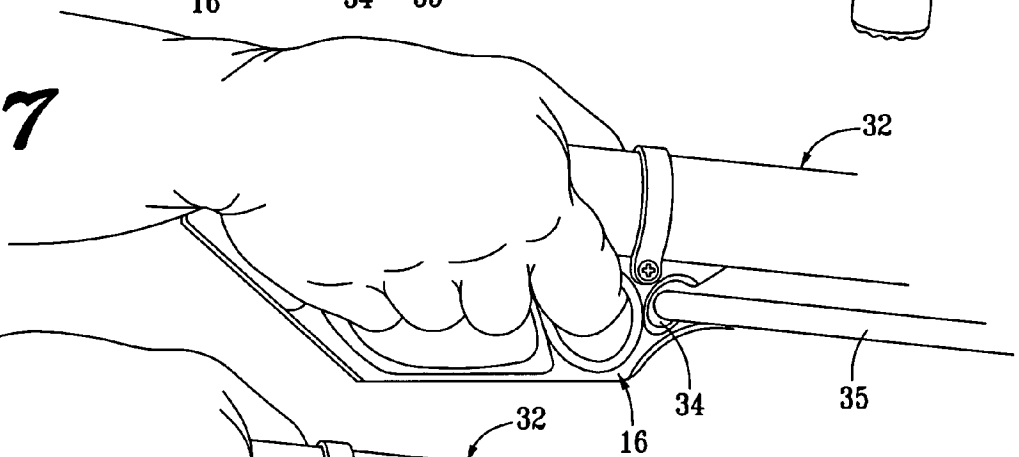
FIG. 7 is a detail view of the tool illustrated in FIG. 6.

The tool attachment connector 22 is preferably of the "snap-on" variety, wherein the tool attachment connector can be readily attached and de-attached from a corresponding lanyard receiving connector 36 located within a hand tool 12. In a preferred embodiment, the tool attachment connector 22 is a push-release, spring-loaded, ball bearing locking pin, as illustrated in FIG. 7. In this embodiment, the tool attachment connector 22 is a male-type connector adapted to be received and retained within a corresponding female receptor 40. This female connector 40 comprises an inwardly projecting flange 42 suitable for engaging and retaining retractable projection members 44, such as ball bearings disposed within the tool attachment connector 22. In a typical embodiment, the tool attachment connector 22 is readily disengaged from the lanyard receiving connector 36 in the hand tool 12 by depressing a spring-loaded button 46 on the back side 48 of the tool attachment connector 22.

Other attachment devices can also be used as the tool attachment connector 22, such as clips, screws, snaps, clamps, hook and loop fasteners and the like.

As illustrated in the drawings, lanyard receiving connectors 36 can be disposed within a wide variety of hand tools 12, including tape measures, screwdrivers, hammers, axes, pliers, screw guns and cutting tools.

Figure 5:
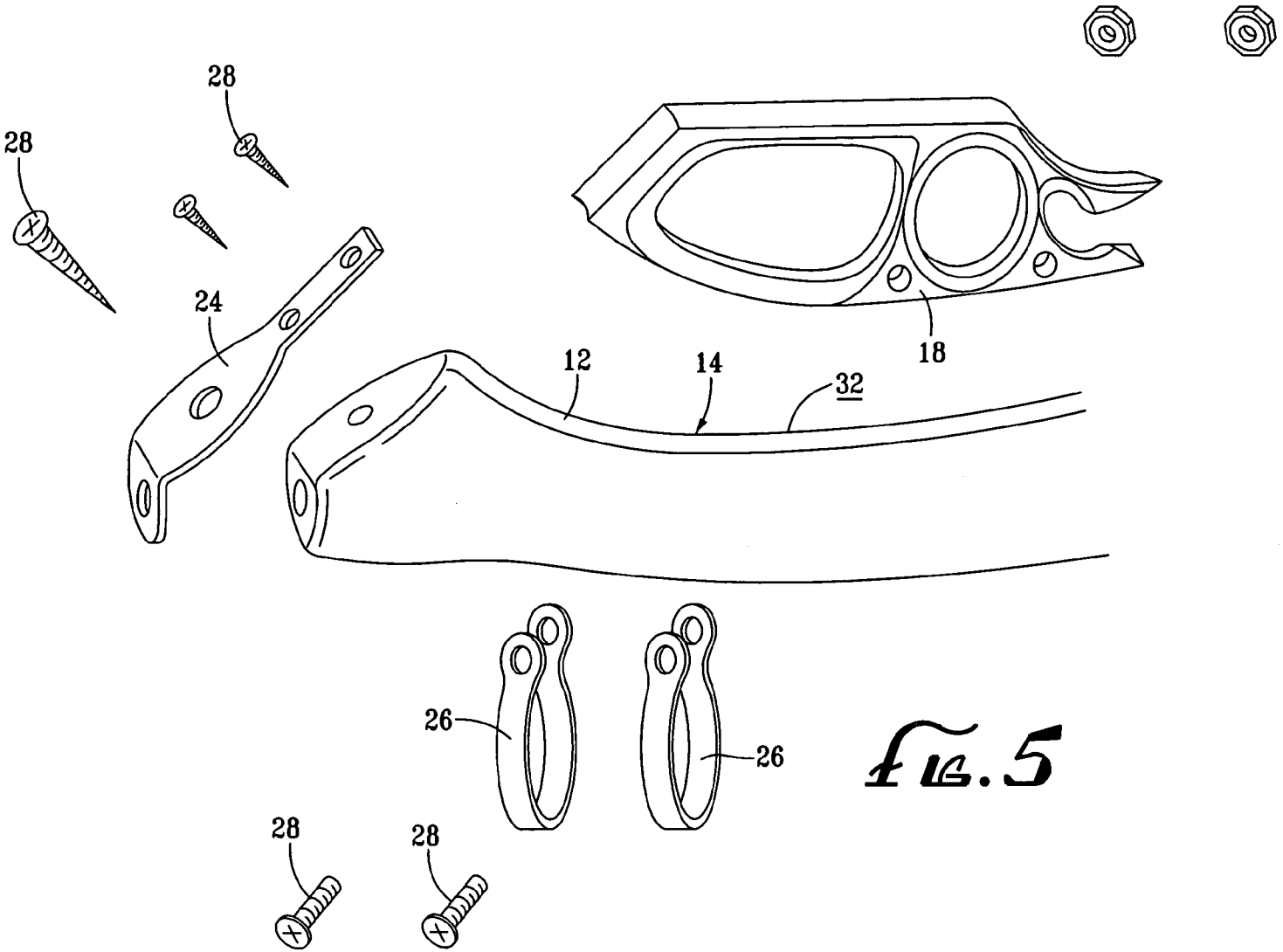
FIG. 5 is an exploded view of the basket illustrated in FIG. 1.

In one embodiment of the invention, the lanyard receiving connector 36 is disposed within a removable handle gripping pad 48 as illustrated in FIGS. 3-5. In this embodiment, the handle gripping pad 48 can be easily attached and deattached from the handle 50 of a hand tool 12 by hook and loop fasteners or snaps.

The lanyard 14 can be used in a wide variety of activities where the dropping of tools 12 presents a significant problem, such as high construction, welding, electrical and telephone work. Also, the lanyard 14 is useful in scuba diving, sky diving, rock climbing, mineralogy, ice climbing, fire fighting and aerial rescue efforts.

In operation, a worker intending to use a particular hand tool 12 disposed within the worker's tool belt 32 first grips the tool attachment connector 22 and pulls a length of the cable 16 out from the cable retainer spool 18 sufficient to reach the hand tool 12 to be used. Next, the worker snaps the tool attachment connector 22 into the corresponding lanyard receiving connector 36 disposed within the tool 12. The worker then uses the hand tool 12 in the usual manner. The fact that the hand tool 12 is tethered to the lanyard 14 does not effect the use of the tool 12 because the retractive force of the spring within the cable retainer spool 18 is almost imperceptibly slight. If the worker should inadvertently drop the tool 12 during its use, the tool 12 only falls the distance of the cable 16. Since the cable 16 is typically only about 3 feet in length, the inadvertently dropping of the tool 12 causes no danger to the tool 12 itself or to other individuals working beneath the worker. When the worker is finished with the hand tool 12, the hand tool 12 is disposed back into the worker's tool belt 32 and the tool attachment connector 22 can be removed from the lanyard receiving connector 36. The lanyard 14 is then ready to be used with a different tool 12 to be selected by the worker from his or her tool belt 32.

In one embodiment of the invention, the base end 12 of a hand tool handle 14 is provided with a "basket" 16 as illustrated in FIGS. 1-8. The basket 16 comprises a "knuckle guard" 18 made from a metal or strong plastic. The knuckle guard 18 comprises one or more finger openings 20. In the embodiment illustrated in the drawings, the knuckle guard 18 is attached to the underside 22 of the base end 12 of the hand tool handle 14 with a rear plate 24 and a pair of clamps 26. In the embodiment illustrated in the drawings, both the rear plate 24 and the clamps 26 are secured by screws 28.

The basket 16 can be used with a hand-tool which is a hammer or a hatchet.

The basket 16 provides the user with additional gripping surfaces 30, making it less arduous to securely hold the handle 14 of the tool 32 during use. This makes it less likely that the user will lose control of the tool 32. It also results in markedly decreased fatigue to the hand muscles of the user, especially after prolonged use of the tool 32. The knuckle guard 18 also protects the fingers of the user from injury due to inadvertent contact of the user's fingers with hard and/or sharp surfaces existing within the work area.

In the embodiment illustrated in the drawings, the knuckle guard 18 includes a forward facing opening 34 which allows a hand tool 34 using the basket 16 to be readily inserted and removed from my safety scabbard invention 33 disclosed in my pending U.S. patent application Ser. No. 09/417,529, now U.S. Pat. No. 6,237,822, the entirety of which is incorporated herein by this reference. The forward facing opening 34 is adapted to surround the guide rail 35 of the safety scabbard 33 as illustrated in FIGS. 6-8.

In another embodiment, the invention is a "grip guard" 36 illustrated in FIGS. 9-14. Like the basket 16, the grip guard 36 comprises a knuckle guard 38 having one or more finger holes 40.

In the embodiment illustrated in the drawings, the grip guard 36 is attached to the base end 12 of the tool handle 14 using a single snap-on male connection pin 42 and one locator pin 44. Both pins 42 and 44 are adapted to be received within corresponding holes 46 disposed within the base end 12 of the hand tool handle 14. The hole 46 in the handle 14 which receives the male connection pin 42 comprises a corresponding female connector 48 adapted to rigidly retain the male connection pin 42 during use. The male connection pin 42 and the female connection pin 48 can be of the same types illustrated in FIG. 16. The embodiment of the grip guard 36 illustrated in the drawings is easily attached and deattached from the base end 12 of the hand tool handle 14 by depressing a spring loaded button 50 on the outside surface 52 of the grip guard 36 to release ball bearings (not shown) projecting laterally into the female connector 48.

Additional snap-on connection pins 42 can also be used in the securing of the grip guard 36 to the handle 14 of the hand tool 32.

In a preferred embodiment, the grip guard further comprises a lanyard receiving connection 53 suitable for attaching the grip guard to my lanyard invention fully described in my co-pending U.S. application Ser. No. 09/864,520, now U.S. Pat. No. 6,487,756, entitled "Hand Tool Lanyard System," which is incorporated herein in its entirety by this reference.

The basket 16 can be used with a hand-tool which is a hammer, axe or cutting tool.

Like the basket 16, the grip guard 36 minimizes the chances that the user will Inadvertently lose control of the tool 32. Also like the basket 16, the grip guard 36 markedly reduces fatigue to the hand muscles of the user by providing the user with additional gripping surfaces 54.

Figure 14:
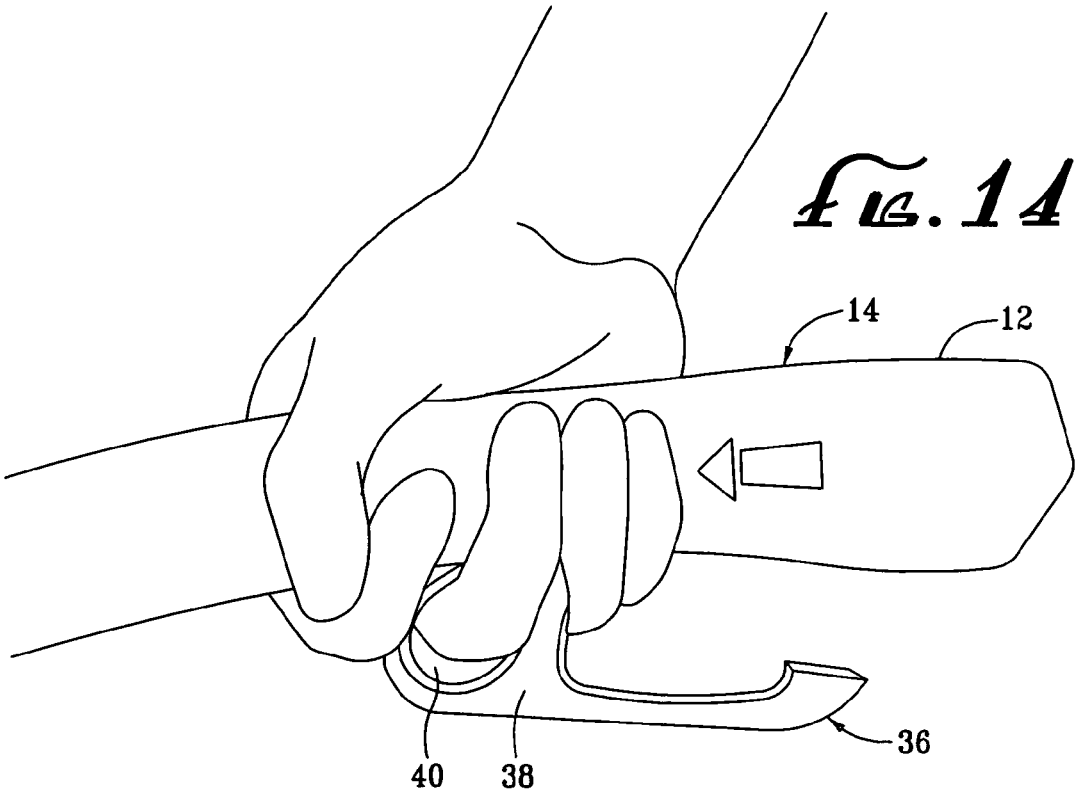
FIG. 14 illustrates the hand tool and grip guard combination illustrated in FIG. 13, wherein the combination is being gripped by the user in an alternative manner.

As illustrated in FIG. 14, the grip guard 36 also allows the user to conveniently "choke up" on the handle 14 of the tool 32 where required by the job to be accomplished.

In another embodiment, the invention is a thumb spur 56 as illustrated in FIGS. 15-18. The thumb spur 56 is a knob which is readily attachable and deattachable to the base end 12 of the hand tool handle 14. In a typical embodiment, the thumb spur 56 comprises an elastomeric body 58 with a quick release male connection pin 60 disposed down the center of the body 58. Typically, the body 58 is made from a soft rubber or synthetic rubber material. Like the snap-on connection pin 42 used in the grip guard 36, the quick release male connection pin 60 allows the snap-on connection of the thumb spur 56 to a corresponding female receptor 62 disposed within the base 12 of the hand tool. In an alternative embodiment, the body 58 of the thumb spur 56 may be attachable to the handle 14 of the hand tool 32 via a threaded screw connection or other connection means known to the art.

The body 58 of the thumb spur 56 is typically between about ¾ inches and about 1¼ inches in length and has a diameter of between about ½ inches and about ¾ inches. Preferably, the male connection pin 60 is freely rotatable within the female connector 62 to minimize blistering of the user's abutting thumb or fingers during use.

Figure 16:
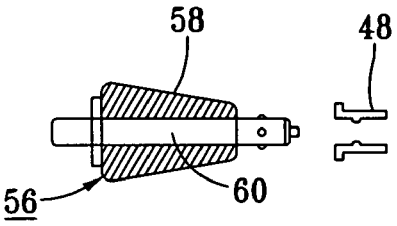
FIG. 16 is a cross-sectional side view of the thumb spur illustrated in FIG. 15.
Figure 15:
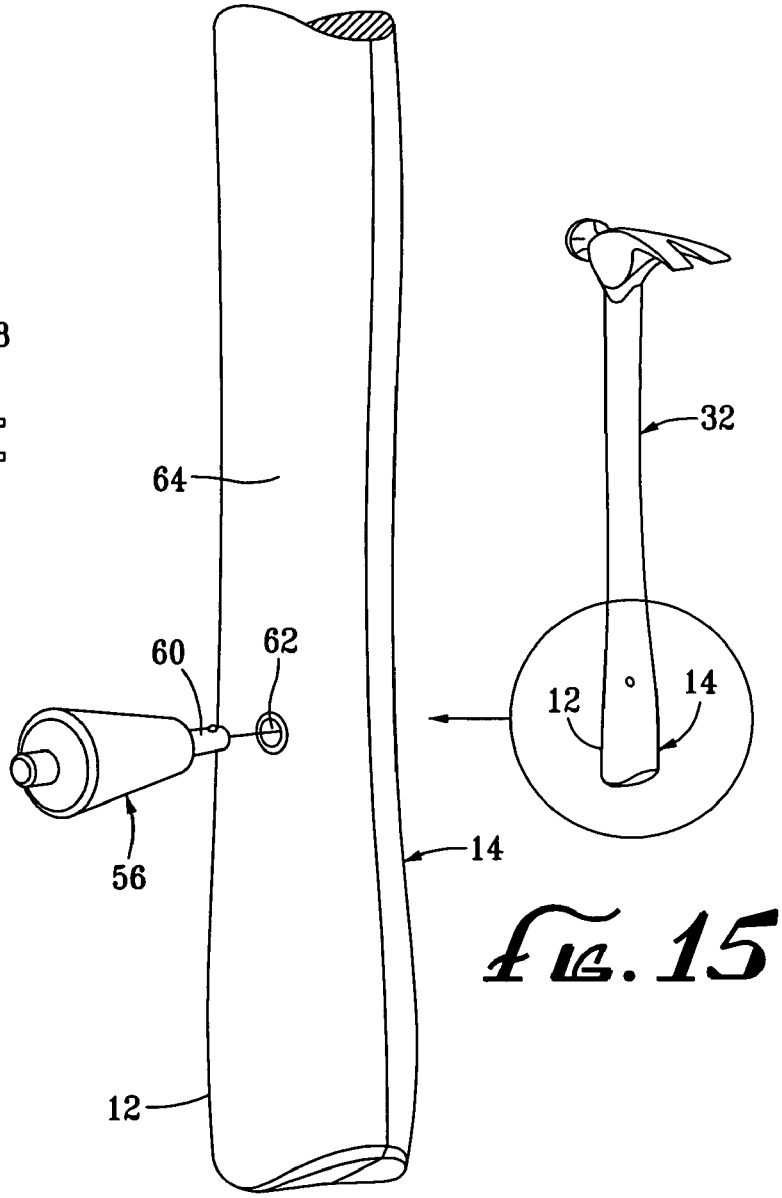
FIG. 15 is a isometric view of a hand tool and thumb spur combination having features of the invention.
Figure 17:
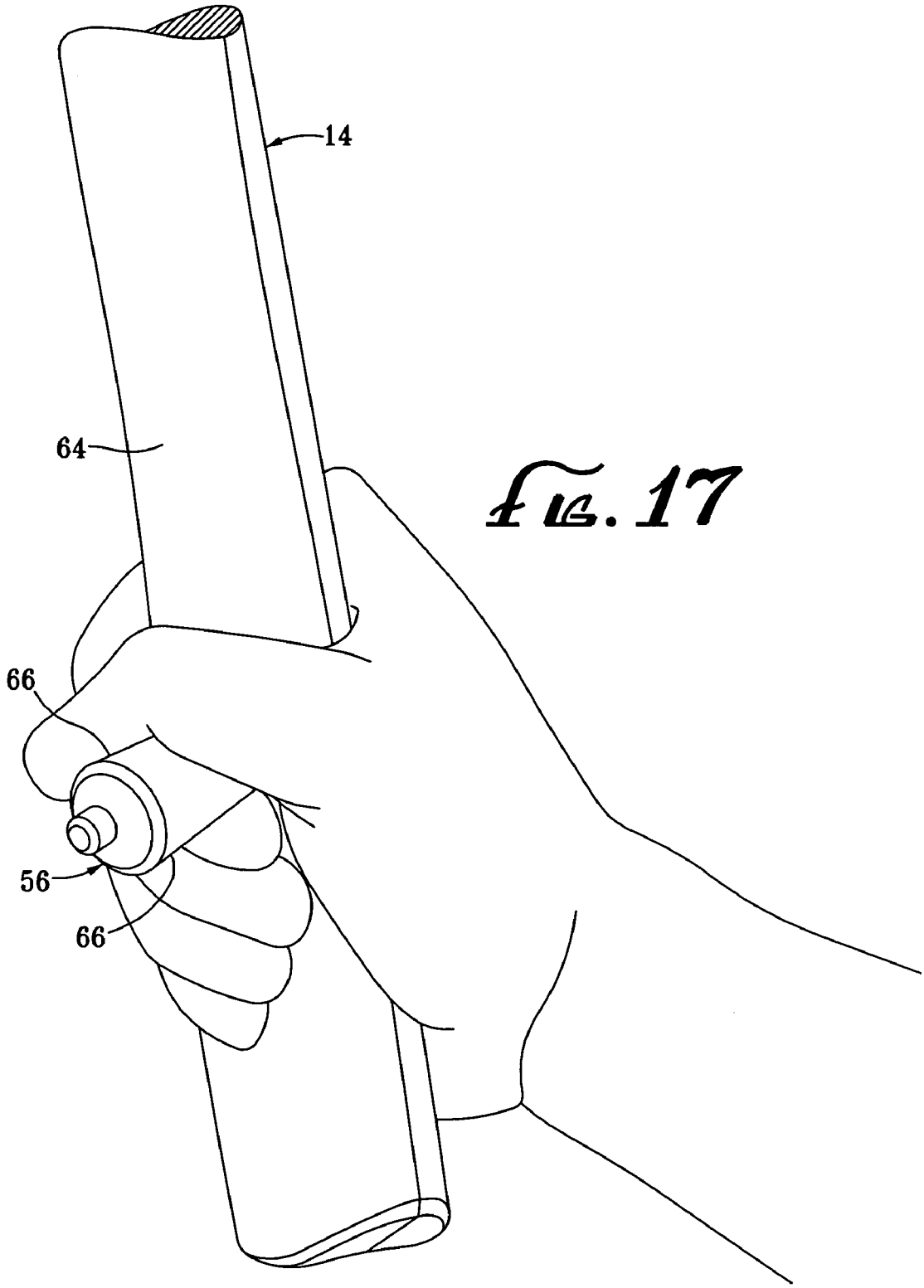
FIG. 17 is a isometric view of a handle and thumb spur combination having features of the invention.
Figure 18:
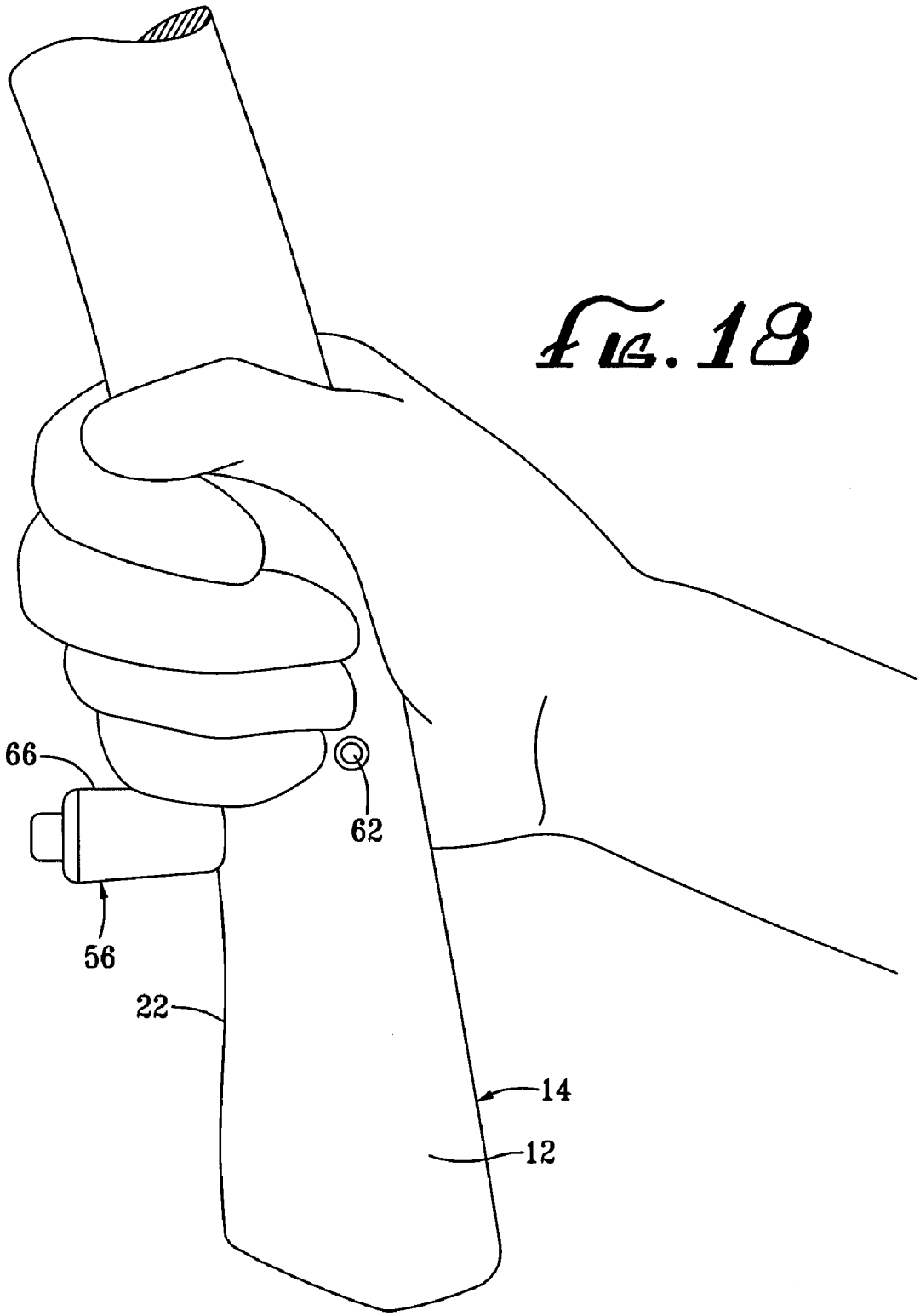
FIG. 18 is an isometric view of an alternative hand tool and thumb spur combination having features of the invention.
Figure 19:
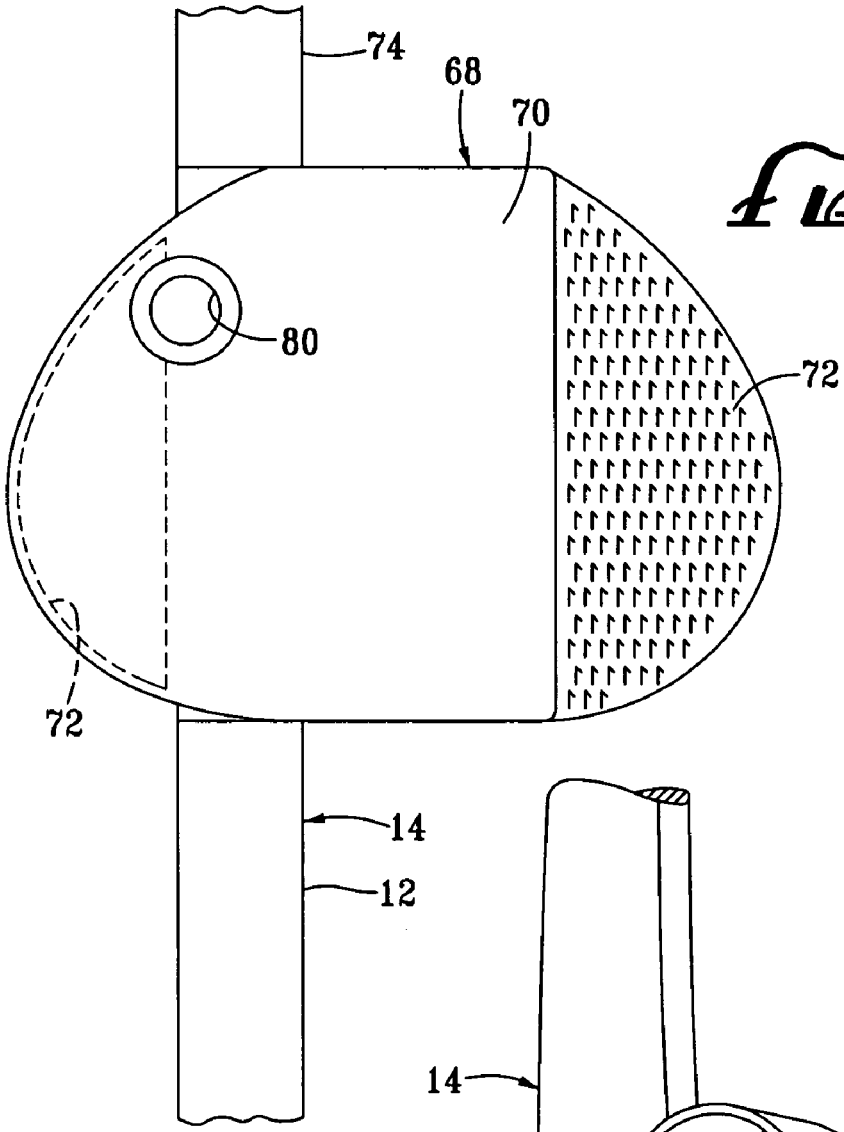
FIG. 19 is an isometric view of a hand tool, thumb spur and chrysalis combination having features of the invention, wherein the chrysalis is shown in a pre-wrapped position.
Figure 20:
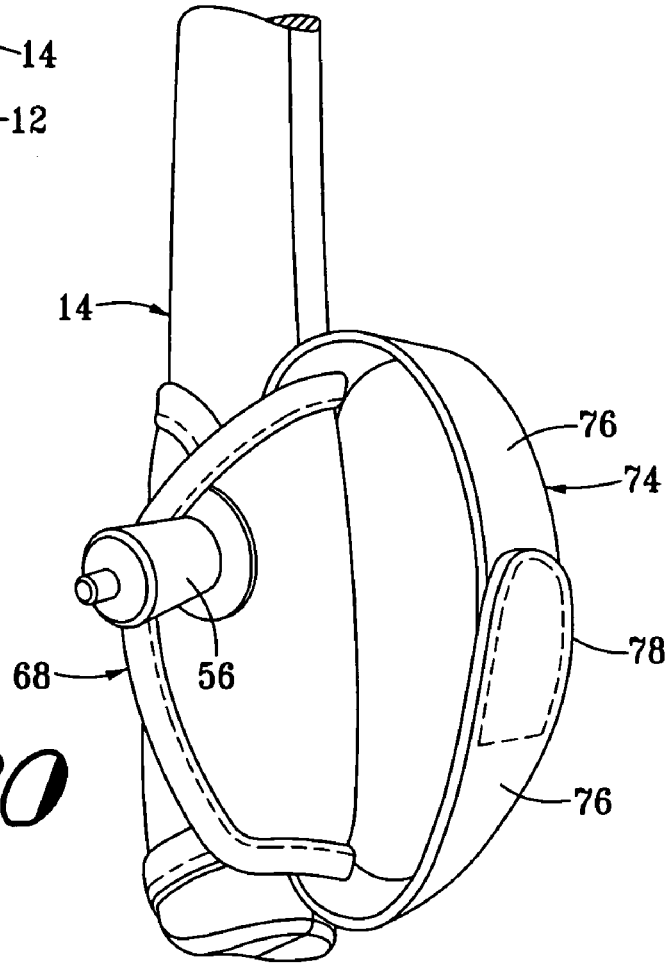
FIG. 20 is an isometric view of the combination of FIG. 19 showing the chrysalis attached to the handle.
Figure 21:
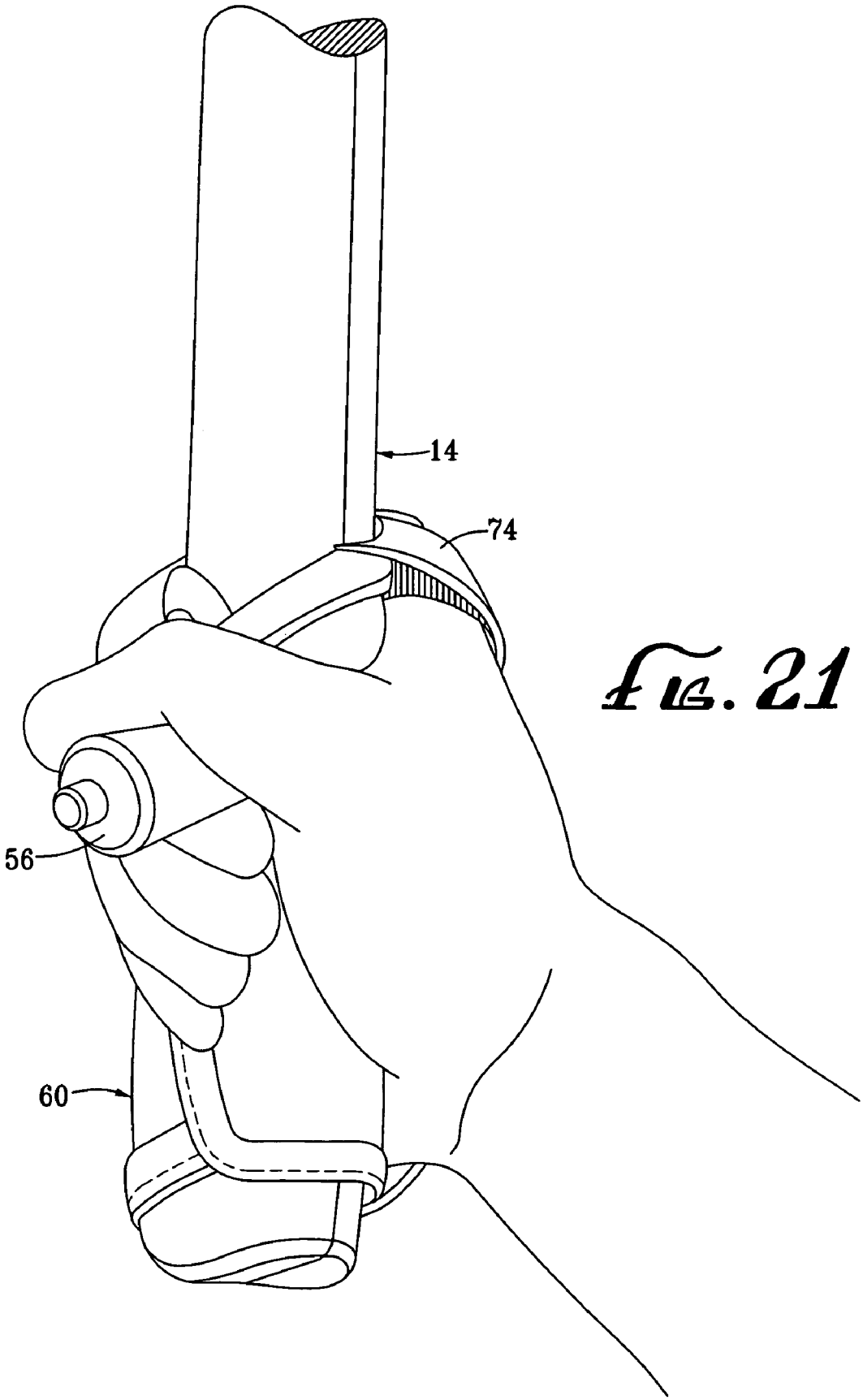
FIG. 21 is an isometric view of the combination illustrated in FIG. 20, showing the combination in use.

The thumb spur 56 can be effectively used when attached to the side 64 of the hand tool handle 14 as illustrated in FIGS. 16 and 17. Alternatively, the thumb spur 56 can be effectively used when attached to the underside 22 of the hand tool handle 14 as illustrated in FIG. 18. When attached to the side 64 of the handle 14, the thumb spur 56 provides the thumb and a finger of the user with additional gripping surfaces 66. When the thumb spur is used on the underside 22 of the hand tool handle 14, the thumb spur 56 provides the additional gripping surfaces 66 to the fingers of the user.

The thumb spur 56 has been found to provide additional gripping ability and control for a wide variety of elongate items. For example, the thumb spur can be used to increase gripping ability and support to baseball bats, tennis rackets, golf clubs, javelins, hockey sticks, pole vault poles, cricket bats, ski poles, hand gun stocks, rifle and shot gun stocks, archery bows, etc. Also, the thumb spur can be advantageously used on a variety of handled tools, such as rakes, picks, mattocks, hoes, long-reach trimmers, brooms, weed whackers, wheel barrows, chain saws, machetes, large knives, cleavers, tenderizers, pot and pan handles, etc. In fact, the thumb spur can be advantageously used with virtually any tool or other object having a handle. The handles of all such tools and objects are preferably manufactured with one or more female receptors 62 so that a thumb spur 56 can be conveniently used with the tool or objects whenever it would be advantageous to do so.

In another embodiment, the invention is a chrysalis 68. The chrysalis 68 comprises a sheet of flexible material 70 adapted to be wrapped around the base end 12 of the hand tool handle 14. Preferably, the flexible material is padded to provide comfort to the hand of the user during use. In the embodiment illustrated in the drawings, the chrysalis 68 is secured to the handle 14 using hook and loop fasteners 72.

Preferably, the chrysalis 68 further comprises a control strap 74 adapted to conform to the back side of the user's hand. Most preferably, the control strap 74 is made from two opposed strap members 76 which are attachable and readily adjustable by hook and loop fasteners 78.

In the embodiments illustrated in the drawings, the chrysalis 68 is further secured to the handle of the hand tool 32 using a thumb spur 56 disposed within a reenforced thumb spur opening 80.

The use of the chrysalis 68, especially in combination with a thumb spur 56, has been found to markedly increase control and comfort in the use of heavy pounding and chopping tools 32, such as hammers and hatchets.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A hand-held instrument comprising a business end and a handle attached to the business end, the handle having a gripping portion and a longitudinal axis, wherein a basket is provided at the gripping portion of the handle, the basket being disposed such that it projects away from the handle in a direction transverse to the longitudinal axis of the handle, the hand-held instrument being a hammer, an axe or a cutting tool, and the basket being a grip guard wherein the grip guard is removably attached to the gripping portion of the handle by a quick release attachment device.

2. The hand-held instrument of claim 1 wherein the basket comprises at least one large opening and one smaller opening.

3. The hand-held instrument of claim 1 wherein the quick release attachment device comprises a male connection pin and wherein the gripping portion of the handle is provided with at least one female receptor capable of accepting and firmly retaining the male connection pin.

4. The hand-held instrument of claim 1 wherein the basket is removably attached to the gripping portion of the handle by at least one clamp.

5. The hand-held instrument of claim 1 wherein the basket is removably attached to the gripping portion of the handle by a pair of clamps and a back plate.

* * * * *